US008468942B2

(12) United States Patent
Maessen et al.

(10) Patent No.: US 8,468,942 B2
(45) Date of Patent: Jun. 25, 2013

(54) METHOD FOR TREATING A LITHOGRAPHIC PRINTING PLATE

(75) Inventors: Peter Maessen, 's Hertogenbosch (NL); Patrick Albert Mertens, Beveren (BE)

(73) Assignee: AGFA Graphics, N.V., Mortsel (BE)

( * ) Notice: Subject to any disclaimer, the term of this patent is extended or adjusted under 35 U.S.C. 154(b) by 460 days.

(21) Appl. No.: 12/743,414

(22) PCT Filed: Nov. 7, 2008

(86) PCT No.: PCT/EP2008/065124

§ 371 (c)(1), (2), (4) Date: Sep. 9, 2010

(87) PCT Pub. No.: WO2009/068426

PCT Pub. Date: Jun. 4, 2009

(65) Prior Publication Data

US 2011/0000384 A1 Jan. 6, 2011

Related U.S. Application Data

(60) Provisional application No. 61/005,155, filed on Dec. 3, 2007.

(30) Foreign Application Priority Data

Nov. 30, 2007 (EP) ..... 07121963

(51) Int. Cl.
*B41F 35/00* (2006.01)

(52) U.S. Cl.
USPC ..... 101/424; 101/483

(58) Field of Classification Search
USPC ..... 101/424
See application file for complete search history.

(56) References Cited

U.S. PATENT DOCUMENTS

| | | | | |
|---|---|---|---|---|
| 4,399,243 | A | 8/1983 | Dixit et al. | |
| 4,504,406 | A | 3/1985 | Dhillon | |
| 4,576,743 | A | 3/1986 | Kita et al. | |
| 4,829,897 | A | 5/1989 | Wyman et al. | |
| 4,997,588 | A | 3/1991 | Gillich | |
| 5,340,495 | A | 8/1994 | Mulcahy et al. | |
| 5,380,453 | A | 1/1995 | Krawack | |
| 5,691,288 | A | 11/1997 | Dhillon | |
| 6,346,156 | B1 | 2/2002 | Fies | |
| 6,544,348 | B1 | 4/2003 | Stöckigt et al. | |
| 7,112,621 | B2 * | 9/2006 | Rohrbaugh et al. | 523/207 |
| 7,485,409 | B2 * | 2/2009 | Nagashima | 430/271.1 |
| 2004/0063033 | A1 * | 4/2004 | Hotta | 430/278.1 |
| 2005/0048856 | A1 * | 3/2005 | Hauser et al. | 442/59 |
| 2005/0069812 | A1 * | 3/2005 | Maemoto et al. | 430/270.1 |
| 2006/0222788 | A1 * | 10/2006 | Hessing et al. | 428/32.24 |
| 2007/0258911 | A1 * | 11/2007 | de Castro et al. | 424/47 |

FOREIGN PATENT DOCUMENTS

| | | | |
|---|---|---|---|
| DE | 197 47 892 | A1 | 5/1999 |
| EP | 0 498 545 | B1 | 8/1992 |
| EP | 0 770 494 | B1 | 5/1997 |
| EP | 0 770 495 | B1 | 5/1997 |
| EP | 0 864 420 | B2 | 9/1998 |
| EP | 0 620 125 | B1 | 3/1999 |
| EP | 0 901 902 | A2 | 3/1999 |
| EP | 0 825 927 | B1 | 8/1999 |
| EP | 0 985 546 | A1 | 3/2000 |
| EP | 0 625 728 | B1 | 8/2000 |
| EP | 0 770 496 | B1 | 3/2002 |
| EP | 0 770 497 | B1 | 4/2002 |
| EP | 0 894 622 | B1 | 3/2003 |
| EP | 1 361 480 | A1 | 11/2003 |
| EP | 0 823 327 | B1 | 11/2004 |
| EP | 1 356 949 | B1 | 7/2006 |
| JP | 2003-054150 | A | 2/2003 |
| JP | 2003-313596 | A | 11/2003 |
| JP | 2007-196557 | A | 8/2007 |
| WO | WO 95/14755 | A1 | 6/1995 |
| WO | WO 01/74984 | | 10/2001 |
| WO | WO 2005/113240 | A1 | 12/2005 |
| WO | WO 2008/003161 | A1 | 1/2008 |
| WO | WO 2009/121755 | A1 | 10/2009 |

OTHER PUBLICATIONS

European Search Report cited in European Patent Application No. 07121963.8, mailed May 15, 2008.
European Search Report cited in European Patent Application No. 08103210.4, mailed Aug. 12, 2008.
International Search Report cited in PCT Application No. PCT/EP2008/065124, mailed Jan. 15, 2009.
International Search Report cited in PCT Application No. PCT/EP2009/053446, mailed Jul. 22, 2009.

* cited by examiner

*Primary Examiner* — Anthony Nguyen
(74) *Attorney, Agent, or Firm* — Leydig, Voit & Mayer, Ltd.

(57) ABSTRACT

Method for cleaning a lithographic printing plate comprising the step of applying a liquid to the plate including an aqueous phase, a solvent phase and at least one alkyl (poly) glucoside, said solvent phase including a mixture comprising aliphatic and/or aromatic hydrocarbons, characterized in that the amount of solvent phase in the liquid is ≦40% wt.

18 Claims, No Drawings

METHOD FOR TREATING A LITHOGRAPHIC PRINTING PLATE

FIELD OF THE INVENTION

The present invention relates to a method for treating a lithographic printing plate.

BACKGROUND OF THE INVENTION

Lithographic printing presses use a so-called printing master such as a printing plate which is mounted on a cylinder of the printing press. The master carries a lithographic image on its surface and a print is obtained by applying ink to said image and then transferring the ink from the master onto a receiver material, which is typically paper. In conventional, so-called "wet" lithographic printing, ink as well as an aqueous fountain solution (also called dampening liquid) are supplied to the lithographic image which consists of oleophilic (or hydrophobic, i.e. ink-accepting, water-repelling) areas as well as hydrophilic (or oleophobic, i.e. water-accepting, ink-repelling) areas. In so-called driographic printing, the lithographic image consists of ink-accepting and ink-adhesive (ink-repelling) areas and during driographic printing, only ink is supplied to the master.

Printing masters are generally obtained by the image-wise exposure and processing of an imaging material called plate precursor. In addition to the well-known photosensitive, so-called pre-sensitized plates, which are suitable for UV contact exposure through a film mask, also heat-sensitive printing plate precursors have become very popular in the late 1990s. Such thermal materials offer the advantage of daylight stability and are especially used in the so-called computer-to-plate method wherein the plate precursor is directly exposed, i.e. without the use of a film mask. The material is exposed to heat or to infrared light and the generated heat triggers a (physico-) chemical process, such as ablation, polymerization, insolubilization by cross linking of a polymer, heat-induced solubilization or particle coagulation of a thermoplastic polymer latex.

The most popular thermal plates form an image by a heat-induced solubility difference in an alkaline developer between exposed and non-exposed areas of the coating. The coating typically comprises an oleophilic binder, e.g. a phenolic resin, of which the rate of dissolution in the developer is either reduced (negative working) or increased (positive working) by the image-wise exposure. During processing, the solubility differential leads to the removal of the non-image (non-printing) areas of the coating, thereby revealing the hydrophilic support, while the image (printing) areas of the coating remain on the support. Typical examples of such plates are described in e.g. EP-A 625728, 823327, 825927, 864420, 894622 and 901902. Negative working embodiments of such thermal materials often require a pre-heat step between exposure and development as described in e.g. EP-625,728.

Negative working plate precursors which do not require a pre-heat step may contain an image-recording layer that works by heat-induced particle coalescence of a thermoplastic polymer particle (latex), as described in e.g. EP-As 770 494, 770 495, 770 496 and 770 497. These patents disclose a method for making a lithographic printing plate comprising the steps of (1) image-wise exposing an imaging element comprising hydrophobic thermoplastic polymer particles dispersed in a hydrophilic binder and a compound capable of converting light into heat, (2) and developing the image-wise exposed element by applying fountain and/or ink.

Some of these thermal processes enable plate-making without wet processing and are for example based on ablation of one or more layers of the coating. At the exposed areas the surface of an underlying layer is revealed which has a different affinity towards ink or fountain than the surface of the unexposed coating.

Other thermal processes which enable plate-making without wet processing are for example processes based on a heat-induced hydrophilic/oleophilic conversion of one or more layers of the coating so that at exposed areas a different affinity towards ink or fountain is created than at the surface of the unexposed coating.

U.S. Pat. No. 4,576,743 discloses a plate cleaner comprising an aqueous solution containing a silicate and at least one is surface active agent selected from a cationic or an amphoteric surface active agent.

A stable composition comprising an alkaline component in combination with a chemical compound that reduces or prevents residue and scum formation such as aromatic sulfur containing compounds and sugars and sugar derivatives is disclosed in EP 1 361 480.

A cleaning composition for lithographic printing plates comprising (i) mainly aliphatic hydrocarbons with a specific boiling point and flash point, (ii) a surfactant with a hydrophilic/lipophilic balance of about 3 to 10 and (iii) an electrolyte selected from a silicate, sulfate, phosfate or nitrate salt is disclosed in U.S. Pat. No. 4,504,406.

U.S. Pat. No. 5,691,288 discloses a composition consisting essentially of a stable emulsion comprising 0.1% wt to 7% wt polyol, 1% wt to 15% wt starches or dextrins, 0.5% wt to 2% wt alkyl benzene sulfonate amine salt and 1.0% wt to 20% wt hydrocarbons containing less than 10% wt aromatic hydrocarbons, 0.1 to 5% wt substituted phenoxypoly(oxythelene) ethanol, about 0.1% wt C12 to C20 alcohol and 0.01% wt to 1.0% wt ethanol amine.

U.S. Pat. No. 4,829,897 discloses a blanket washing medium comprising 5% wt-35% wt water and 65% wt-95% wt of a water insoluble phase that contains certain hydrocarbons in a specific proportion and a surfactant with a HLB value of 3-11.

A cleaning composition for removing inks and/or oil residues located on a surface of a printing apparatus comprising an alkyl (poly)glucoside is disclosed in U.S. Pat. No. 6,346,156.

WO 95/14755 discloses a cleaning composition comprising a mixture of a hydrocarbon solvent, a low VOC $C_{12}$-$C_{26}$ alkyl benzene wherein the alkyl group is a $C_6$-$C_{20}$ alkyl group, a low VOC $C_{16}$-$C_{30}$ alkyl naphtalene wherein the alkyl group is a $C_6$-$C_{20}$ alkyl and optionally a surfactant.

Before, during and after the printing step, a lithographic printing plate is in general treated with various liquids for improving the lithographic properties of the image and non-image areas. Such liquids are applied for example to improve the hydrophilic properties of the non-image areas and to protect, restore or even enhance the hydrophobicity of the image areas. It is of high importance that these fluids, commonly referred to as plate treating liquids, do not deteriorate the image and/or the non-image areas throughout and well after their application. Due to the bivalent nature of such a treatment—i.e. improving both hydrophilic and hydrophobic areas—the treating liquid typically contains both water and organic solvent(s) and is thus an emulsion; preferably an oil-in-water (O/W) emulsion.

The cleaning strength or so-called "ink solvency" of plate cleaning liquids or plate cleaners—i.e. the ability to remove ink from a plate—is mainly determined by the composition of the plate cleaner and more specificly, by the concentration and/or nature of the organic solvent. Aromatic hydrocarbon solvents are preferred over aliphatic hydrocarbon solvents as they exhibit a very good ink solvency. Commonly used aromatic hydrocarbon solvents are mixtures of $C_9$-$C_{10}$ alkylbenzene hydrocarbons. However, cleaning liquids containing such aromatic hydrocarbons have a low flashpoint and thus create a high risk of explosure to the cleaning liquids not only in the pressroom environment but also during transport. Aromatic hydrocarbons with higher flashpoints such as for example mixtures of $C_{10}$-$C_{11}$ alkylbenzene hydrocarbon solvents are preferably not used as they have a reduced ink solvency and they usually contain naphthalene and/or naphthalene derivatives. The presence of naphtalene and/or naphthalene derivatives in cleaning liquids should be limited as these compounds have a nasty smell and are classified as carcinogenic compounds; for example they are classified as category 2B carcinogens by the International Agency for Research on Cancer (IARC 2002). The flashpoint of $C_9$-$C_{10}$ aromatic alkylbenzene hydrocarbon solvents can for example be increased by mixing them with aliphatic hydrocarbon solvents with a higher flashpoint. However, the solvent level of such a plate cleaner significantly increases which is unfavourable from both an environmental and economic point of view.

Therefore, there is still an urgent need for efficient treating liquids which meet high standards of health and safety.

SUMMARY OF THE INVENTION

It is an object of the present invention to provide a cleaning liquid for a printing plate which has an excellent ink solvency, a high flash point, a low odor and which complies with high health and safety requirements at an acceptable cost price.

This object is realized by claim 1, i.e. a method for cleaning a lithographic printing plate comprising the step of applying a liquid to the plate including an aqueous phase, a solvent phase and at least one alkyl (poly)glucoside, said solvent phase including a mixture comprising aliphatic and/or aromatic hydrocarbons, characterized in that the amount of solvent phase in the liquid is ≦40% wt.

It was surprisingly found that a cleaning liquid comprising an aqueous phase, an alkyl(poly)glucoside is surfactant and 40% wt or less of a solvent phase containing a mixture of aromatic hydrocarbons and/or aliphatic hydrocarbons, has an excellent ink solvency.

Other features, elements, steps, characteristics and advantages of the present invention will become more apparent from the following detailed description of preferred embodiments of the present invention.

DETAILED DESCRIPTION OF THE INVENTION

The treating liquid used in the present invention, also referred to as cleaning liquid or plate cleaner, is an emulsion, preferably an oil-in-water emulsion, comprising an aqueous phase and a solvent phase. The cleaning liquid preferably has a flash point above 60° C. The total level of the solvent phase in the emulsion is ≦40% wt, preferably ≦35% wt, more preferably ≦30% wt. The solvent phase ranges between 10% wt-40% wt, more preferably between 15% wt-35% wt and most preferably between 20% wt and 30% wt. The emulsion preferably contains ≧60% wt of water, more preferably the level of water ranges between 60% wt and 90% wt, more preferably between 65% wt and 85% wt and most preferably between 70% wt and 80% wt.

The solvent phase comprises a mixture of one or more aromatic and/or one or more aliphatic hydrocarbon solvents. The aromatic hydrocarbon solvent is preferably a mixture of $C_{10}$-$C_{11}$ hydrocarbons. This mixture of $C_{10}$-$C_{11}$ hydrocarbons may contain fractions of higher or lower hydrocarbons; i.e. hydrocarbons with a higher or lower carbon content. The $C_{10}$-$C_{11}$ hydrocarbon mixture is preferably a mixture of alkyl substituted benzenes; more preferably a mixture of benzenes substituted with single or multiple $C_1$-$C_5$ alkyl groups. To meet high health and safety standards, ethylbenzene is preferably not present in the solvent phase. For the same reason, the level of naphtalene and naphtalene derivatives in the solvent phase is preferably below 1% wt, more preferably below 0.5% wt and most preferably below 0.1% wt. The aromatic $C_{10}$-$C_{11}$ hydrocarbons preferably have a flash point above 60° C. Preferred examples of $C_{10}$-$C_{11}$ aromatic hydrocarbon mixtures include SOLVESSO 150™, SOLVESSO 150 ND™ and SOLVESSO 150 ULN™, commercially available from ExxonMobil Chemical.

The aliphatic hydrocarbons are preferably selected from $C_7$-$C_{14}$ aliphatic hydrocarbons, however fractions of lower and/or higher hydrocarbons may be present such as for example $C_5$-$C_6$ and/or $C_{15}$-$C_{18}$ aliphatic hydrocarbons. They may be linear, branched or cyclic and preferably have a flash point above 60° C. Specific examples include EXXSOL D-60™ commercially available from ExxonMobil Chemical and SHELLSOL D-60™, commercially available from Shell Chemicals.

The weight ratio of the aliphatic to the aromatic hydrocarbons in the solvent phase ranges preferably between 5/1 to 1/5, more preferably between 3/1 to 1/3 and most preferably between 2/1 to 1/2. In a particularly preferred embodiment, the cleaning liquid contains aliphatic and aromatic hydrocarbons in a 2/1 ratio. Especially in the embodiment where the aromatic hydrocarbons may contain naphtalene derivatives, a 2/1 ratio of aliphatic to aromatic hydrocarbons is favourable. Alternatively, the solvent phase may contain only aromatic hydrocarbons. It is highly preferred that the level of naphtalene and naphtalene derivatives in the solvent phase containing only aromatic hydrocarbons such as a mixture of $C_{10}$-$C_{11}$ hydrocarbons, is preferably below 1% wt, more preferably below 0.5% wt and most preferably below 0.1% wt.

The cleaning liquid further comprises at least one surfactant—i.e. alkyl (poly)glucoside—which provides stability to the emulsion. It was surprisingly found that the non-ionic surfactant alkyl (poly)glucoside provides already at a very low level stability to the emulsion. The cleaning liquid comprises at least one alkyl (poly)glucoside and the surfactant is preferably used within the range of 0.05% wt to 2% wt. Above 2% wt, the ink solvency of the cleaning liquid significantly deteriorates. More preferably, the surfactant is used within the range of 0.1% wt to 1.8% wt, most preferably within the range of 0.5% wt to 1.6% wt. The alkyl (poly)glucoside surfactant may be present in the aqueous phase, the solvent phase or in both phases of the emulsion. It may also be present at the interface between both phases. Alkyl (poly)glucoside is a non-ionic surfactant comprising at least one alkyl group and at least one glucoside group. The alkyl group preferably contains 4 to 30 carbon atoms, more preferably 7 to 25 carbon atoms and most preferably 8 to 20 carbon atoms. The alkyl group may be linear, branched, saturated or unsaturated; preferably the alkyl group is linear and saturated. The (poly) glucoside group comprises at least one glucoside group—i.e. monoglycoside, or more than one glucoside group. A glucoside is derived from glucose; glucose is produced upon hydrolisation a glycoside. A glucoside contains a glycosidic bond which is a certain type of functional group that joins a glucose molecule to another compound. For example, a glycosidic bond may be formed between the hemiacetal group (position 1) of a glucose molecule (Formula 1) and the hydroxyl group of an organic compound such as an alcohol whereby an alkyl glucoside is formed. Also, a glucoside having an alkylgroup at the 2, 3, or 4-position may be formed; however the 1-position is preferred. A glycosidic bond may be formed between a glucose molecule or an alkyl glucoside and another glucose molecule whereby a polyglucoside or alkyl (poly)glucoside is formed. The degree of polymerisation of the polyglucoside group preferably ranges between 1 and 10, more preferably between 1 and 4, most preferably between 1 and 3. The additional glucose and/or glucoside groups may be attached via the 1, 2, 3 or 4-position to any position on the glucoside or alkylglucoside group. Preferably, the additional glucose and/or glucoside groups are predominately attached via the 1-position to the 4-position of the glucoside or alkylglucoside group ($C^1$—O—$C^4$ bond involving $C^1$ of one glucose molecule or glucoside group and $C^4$ of another) or to the 6-position of the glucoside or alkylglucoside group ($C^1$—O—$C^6$ bond involving $C^1$ of one glucose molecule or glucoside group and $C^6$ of another). Attachment of the 1-position to the 6-position ($C^1$—O—$C^6$) of the glucoside or alkylglucoside group is preferred.

Formula I: numbering glucose

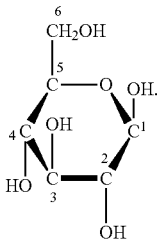

The alkyl (poly)glucoside is preferably represented by formula II.

Formula II

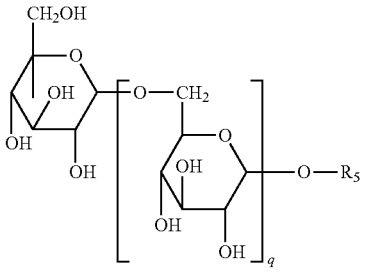

wherein $R^5$ is an alkyl group, preferably a linear alkyl chain comprising preferably 4 to 30 carbon atoms;

q is an integer ranging between 0-9.

In a preferred embodiment, $R^5$ is a linear alkyl chain comprising 7 to 25 carbon atoms, more preferably 8 to 20 carbon atoms; and q is an integer ranging between 0 and 3, more preferably between 0 and 2.

Suitable examples of alkyl (poly)glucosides which are commercially available include, but are not limited to are GLUCOPON™ products available from Cognis such as for example Glucopon 425 HH™, Glucopon 600 EC™, Glucopon 600 CSUP™, Glucopon 625 UP™ and Glucopon 625 EC™.

As known in the art other suitable additives may be present in the cleaning liquid—in the solvent phase and/or in the aqueous phase—and include for example hydrophilisers such as sorbitol or glycerol, chelating agents, compounds comprising at least one acid group such as for example phosphoric acid, citric acid, gluconic acid, glycolic acid or polyvinylphosphonic acid, biocides, buffers, pH adjusters like mineral acids or bases, corrosion inhibitors, antifoaming agents, other surfactants, desensitizing agents such as nitrate salts and/or water-soluble polymers with an excellent film forming ability such as polyvinyl alcohol, polyvinylpyrrolidone, partially hydrolyzed polyvinyl acetate, protective agents, fatty acid esters such as alkylesters of fatty acids, dyes, colorants, fragrances, antioxidants, preservatives such as phenol and derivatives thereof, thickening agents such as xanthane gum, gelatin, gum arabic, various starches, carbohydrates or cellulose derivatives such as carboxymethyl cellulose, methyl or ethyl cellulose, hemicellulose, hydroxyethyl cellulose.

The cleaning liquid used in the method of the present invention is applied to a printing plate; it may be applied before, after and/or during the printing step. The cleaning liquid is generally used to remove ink and debris from the plate, to desensitize the non-image areas and to restore the hydrophilic properties of the non-image areas, which upon time may become less able to repel ink and may tend to retain some ink—known in the art as scumming. An efficient plate cleaner removes ink, dirt, oxidation spots, smudge and/or other imperfections without scratching or abrading the plate. The liquid can also be used to remove staining formed at any stage from plate-making through printing.

The treating liquids may be applied by for example wiping the printing plate with e.g. a cotton pad or sponge soaked with the treating liquid before and/or after mounting the plate on the press and also during and/or after the press run. The cotton pad or sponge may optionally be wetted with fountain solution before and/or after they are soaked with the treating liquid. The wiping may be combined with mechanical rubbing, e.g. by using a (rotating) brush. Alternatively, the treating liquid may be applied by spraying, dipping or coating it on to the printing plate. Various coating techniques, such as dip coating, spray coating or "on the fly" coating (during printing), slot coating, reverse roll coating or electrochemical coating may be employed; most preferred are dip and spray coating.

The lithographic printing plate used in the present invention comprises a support which has a hydrophilic surface or which is provided with a hydrophilic layer. The support may be a sheet-like material such as a plate or it may be a cylindrical element such as a sleeve which can be slid around a print cylinder of a printing press. Preferably, the support is a metal support such as aluminum or stainless steel. The support can also be a laminate comprising an aluminum foil and a plastic layer, e.g. polyester film.

A particularly preferred lithographic support is an electrochemically grained and anodized aluminum support. The aluminum support has usually a thickness of about 0.1-0.6 mm. However, this thickness can be changed appropriately depending on the size of the printing plate used and/or the size of the plate-setters on which the printing plate precursors are exposed. The aluminium is preferably grained by electrochemical graining, and anodized by means of anodizing techniques employing phosphoric acid or a sulphuric acid/phosphoric acid mixture. Methods of both graining and anodization of aluminum are very well known in the art.

By graining (or roughening) the aluminum support, both the adhesion of the printing image and the wetting characteristics of the non-image areas are improved. By varying the type and/or concentration of the electrolyte and the applied voltage in the graining step, different type of grains can be obtained. The surface roughness is often expressed as arithmetical mean center-line roughness Ra (ISO 4287/1 or DIN 4762) and may vary between 0.05 and 1.5 μm. The aluminum substrate of the current invention has preferably an Ra value below 0.45 μm, more preferably below 0.40 μm and most preferably below 0.30 μm. The lower limit of the Ra value is preferably about 0.1 μm. More details concerning the preferred Ra values of the surface of the grained and anodized aluminum support are described in EP 1 356 926.

By anodising the aluminum support, its abrasion resistance and hydrophilic nature are improved. The microstructure as well as the thickness of the $Al_2O_3$ layer are determined by the anodising step, the anodic weight (g/m$^2$ $Al_2O_3$ formed on the aluminium surface) varies between 1 and 8 g/m$^2$. The anodic weight is preferably ≧3 g/m$^2$, more preferably ≧3.5 g/m$^2$ and most preferably ≧4.0 g/m$^2$.

An optimal ratio between pore diameter of the surface of the aluminium support and the average particle size of hydrophobic thermoplastic particles which may be provided thereon, may enhance the press life of the printing plate and may improve the toning behavior of the prints. This ratio of the average pore diameter of the surface of the aluminium support to the average particle size of the thermoplastic particles which may be present in the image-recording layer of the coating, preferably ranges from 0.05:1 to 1.0:1, more preferably from 0.10:1 to 0.80:1 and most preferably from 0.15:1 to 0.65:1.

The grained and anodized aluminum support may be subject to a so-called post-anodic treatment to improve the hydrophilic properties of its surface. For example, the aluminum support may be silicated by treating its surface with a sodium silicate solution at elevated temperature, e.g. 95° C. Alternatively, a phosphate treatment may be applied which involves treating the aluminum oxide surface with a phosphate solution that may further contain an inorganic fluoride. Further, the aluminum oxide surface may be rinsed with a citric acid or citrate solution. This treatment may be carried out at room temperature or may be carried out at a slightly elevated temperature of about 30 to 50° C. A further interesting treatment involves rinsing the aluminum oxide surface with a bicarbonate solution. Still further, the aluminum oxide surface may be treated with polyvinylphosphonic acid, polyvinylmethylphosphonic acid, phosphoric acid esters of polyvinyl alcohol, polyvinylsulphonic acid, polyvinylbenzenesulphonic acid, sulphuric acid esters of polyvinyl alcohol, and acetals of polyvinyl alcohols formed by reaction with a sulphonated aliphatic aldehyde.

Another useful post-anodic treatment may be carried out with a solution of polyacrylic acid or a polymer comprising at least 30 mol % of acrylic acid monomeric units, e.g. GLASCOL E15, a polyacrylic acid, commercially available from Ciba Speciality Chemicals.

The support can also be a flexible support, which may be provided with a hydrophilic layer, hereinafter called 'base layer'. The flexible support is e.g. paper, plastic film or aluminum. Preferred examples of plastic film are polyethylene terephthalate film, polyethylene naphthalate film, cellulose acetate film, polystyrene film, polycarbonate film, etc. The plastic film support may be opaque or transparent.

The base layer is preferably a cross-linked hydrophilic layer obtained from a hydrophilic binder cross-linked with a hardening agent such as formaldehyde, glyoxal, polyisocyanate or a hydrolyzed tetra-alkylorthosilicate. The latter is particularly preferred. The thickness of the hydrophilic base layer may vary in the range of 0.2 to 25 μm and is preferably 1 to 10 μm. More details of preferred embodiments of the base layer can be found in e.g. EP-A 1 025 992.

The lithographic printing plate used in the present invention is obtained by exposing and optionally developing a printing plate precursor comprising a heat and/or light-sensitive coating on a hydrophilic support. The precursor can be negative or positive working, i.e. can form ink-accepting areas at exposed or at non-exposed areas respectively. Below, suitable examples of heat- and light-sensitive coatings are discussed in detail.

Heat-Sensitive Printing Plate Precursors.

The imaging mechanism of thermal printing plate precursors can be triggered by direct exposure to heat, e.g. by means of a thermal head, or by the light absorption of one or more compounds in the coating that are capable of converting light, more preferably infrared light, into heat.

A first suitable example of a thermal printing plate precursor is a precursor based on heat-induced coalescence of hydrophobic thermoplastic polymer particles which are preferably dispersed in a hydrophilic binder, as described in e.g. EP 770 494, EP 770 495, EP 770 497, EP 773 112, EP 774 364, EP 849 090, EP 1 614 538, EP 1 614 539, EP 1 614 540, EP 1 777 067, EP 1 767 349, WO 2006/037716, WO 2006/133741 and WO 2007/045515.

Preferably such an image-recording layer comprises an organic compound, characterised in that said organic compound comprises at least one phosphonic acid group or at least one phosphoric acid group or a salt thereof, as described in WO 2007/045515. In a particularly preferred embodiment the image-recording layer comprises an organic compound as represented by formula III:

Formula III

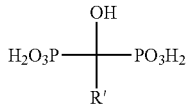

or a salt thereof and wherein R' independently represent hydrogen, an optionally substituted straight, branched, cyclic or heterocyclic alkyl group or an optionally substituted aryl or (hetero)aryl group.

Compounds according to Formula III may be present in the image-recording layer in an amount between 0.05 and 15% by weight, preferably between 0.5 and 10% by weight, more preferably between 1 and 5% by weight relative to the total weight of the ingredients of the image-recording layer.

In a second suitable embodiment, the thermal printing plate precursor comprises a coating comprising an aryldiazosulfonate homo- or copolymer which is hydrophilic and soluble in the processing liquid before exposure to heat or UV light and rendered hydrophobic and less soluble after such exposure.

Preferred examples of such aryldiazosulfonate polymers are the compounds which can be prepared by homo- or copolymerization of aryldiazosulfonate monomers with other aryldiazosulfonate monomers and/or with vinyl monomers such as (meth)acrylic acid or esters thereof, (meth)acrylamide, acrylonitrile, vinylacetate, vinylchloride, vinylidene chloride, styrene, α-methyl styrene etc. Suitable aryldiazosulfonate monomers are disclosed in EP-A 339393, EP-A 507008 and EP-A 771645 and suitable aryldiazosulfonate polymers are disclosed in EP 507,008, EP 960,729, EP 960,730 and EP1,267,211.

A further suitable thermal printing plate precursor is positive working and relies on heat-induced solubilization of an oleophilic resin. The oleophilic resin is preferably a polymer that is soluble in an aqueous developer, more preferably an aqueous alkaline developing solution with a pH between 7.5 and 14. Preferred polymers are phenolic resins e.g. novolac, resoles, polyvinyl phenols and carboxy substituted polymers. Typical examples of these polymers are described in DE-A-4007428, DE-A-4027301 and DE-A-4445820. The amount of phenolic resin present in the first layer is preferably at least 50% by weight, preferably at least 80% by weight relative to the total weight of all the components present in the first layer.

In a preferred embodiment, the oleophilic resin is preferably a phenolic resin wherein the phenyl group or the hydroxy group is chemically modified with an organic substituent. The phenolic resins which are chemically modified with an organic substituent may exhibit an increased chemical resistance against printing chemicals such as fountain solutions or plate treating liquids such as plate cleaners. Examples of such chemically modified phenolic resins are described in EP-A 0 934 822, EP-A 1 072 432, U.S. Pat. No. 5,641,608, EP-A 0 982 123, WO 99/01795, EP-A 02 102 446, EP-A 02 102 444, EP-A 02 102 445, EP-A 02 102 443, EP-A 03 102 522. The modified resins described in EP-A 02 102 446, are preferred, especially those resins wherein the phenyl-group of said phenolic resin is substituted with a group having the structure —N═N-Q, wherein the —N═N— group is covalently bound to a carbon atom of the phenyl group and wherein Q is an aromatic group.

In the latter embodiment the coating may comprise a second layer that comprises a polymer or copolymer (i.e. (co)polymer) comprising at least one monomeric unit that comprises at least one sulfonamide group. This layer is located between the layer described above comprising the oleophilic resin and the hydrophilic support. Hereinafter, 'a (co)polymer comprising at least one monomeric unit that comprises at least one sulfonamide group' is also referred to as "a sulphonamide (co)polymer". The sulphonamide (co)polymer is preferably alkali soluble. The sulphonamide group is preferably represented by —NR—$SO_2$—, —$SO_2$—NR— or —$SO_2$—NRR' wherein R and R' each independently represent hydrogen or an organic substituent.

Sulfonamide (co)polymers are preferably high molecular weight compounds prepared by homopolymerization of monomeric units containing at least one sulfonamide group or by copolymerization of such monomeric units and other polymerizable monomeric units.

Examples of monomeric units containing at least one sulfonamide group include monomeric units further containing at least one polymerizable unsaturated bond such as an acryloyl, allyl or vinyloxy group. Suitable examples are disclosed in U.S. Pat. No. 5,141,838, EP 1545878, EP 909,657, EP 0 894 622 and EP 1,120,246.

Examples of monomeric units copolymerized with the monomeric units containing at least one sulfonamide group include monomeric units as disclosed in EP 1,262,318, EP 1,275,498, EP 909,657, EP 1,120,246, EP 0 894 622 and EP 1,400,351.

Suitable examples of sulfonamide (co)polymers and/or their method of preparation are disclosed in EP-A 933 682, EP-A 982 123, EP-A 1 072 432, WO 99/63407 and EP 1,400,351.

A highly preferred example of a sulfonamide (co)polymer is a homopolymer or copolymer comprising a structural unit represented by the following general formula (IV):

Formula IV

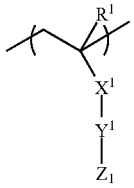

wherein:

R' represents hydrogen or a hydrocarbon group having up to 12 carbon atoms; preferably $R^1$ represents hydrogen or a methyl group;

$X^1$ represents a single bond or a divalent linking group. The divalent linking group may have up to 20 carbon atoms and may contain at least one atom selected from C, H, N, O and S. Preferred divalent linking groups are a linear alkylene group having 1 to 18 carbon atoms, a linear, branched, or cyclic group having 3 to 18 carbon atoms, an alkynylene group having 2 to 18 carbon atoms and an arylene group having 6 to 20 atoms, —O—, —S—, —CO—, —CO—O—, —O—CO—, —CS—, —$NR^hR^i$—, —CO—$NR^h$—, $NR^h$—CO—, —$NR^h$—CO—O—, —O—CO—$NR^h$—, —$NR^h$—CO—$NR^i$—, —$NR^h$—CS—$NR^i$—, a phenylene group, a naphtalene group, an anthracene group, a heterocyclic group, or combinations thereof, wherein $R^h$ and $R^i$ each independently represent hydrogen or an optionally substituted alkyl, alkenyl, alkynyl, cycloalkyl, heterocyclic, aryl, heteroaryl, aralkyl or heteroaralkyl group. Preferred substituents on the latter groups are an alkoxy group having up to 12 carbon atoms, a halogen or a hydroxyl group. Preferably $X^1$ is a methylene group, an ethylene group, a propylene group, a butylene group, an isopropylene group, cyclohexylene group, a phenylene group, a tolylene group or a biphenylene group;

$Y^1$ is a bivalent sulphonamide group represented by —$NR^j$—$SO_2$— or —$SO_2$—$NR^k$— wherein $R^j$ and $R^k$ each independently represent hydrogen, an optionally substituted alkyl, alkanoyl, alkenyl, alkynyl, cycloalkyl, heterocyclic, aryl, heteroaryl, aralkyl or heteroaralkyl group or a group of the formula —C(═N)—NH—$R^2$, wherein $R^2$ represents hydrogen or an optionally substituted alkyl or aryl group;

$Z^1$ represents a terminal group preferably represented by hydrogen or an optionally substituted linear, branched, or cyclic alkylene or alkyl group having 1 to 18 carbon atoms such as a methyl group, an ethyl group, a propyl group, an isopropyl group, a butyl group, an isobutyl group, a t-butyl group, a s-butyl group, a pentyl group, a hexyl group, a cyclopentyl group, a cyclohexyl group, an octyl group, an optionally substituted arylene or aryl group having 6 to 20 carbon atoms; an optionally substituted hetero-arylene or heteroaryl group; a linear, branched, or cyclic alkenylene or alkenyl group having 2 to 18 carbon atoms, a linear, branched, or cyclic alkynylene or alkynyl group having 2 to 18 carbon atom or an alkoxy group.

Examples of preferred substituents optionally present on the groups representing $Z^1$ are an alkyl group having up to 12 carbon atoms, an alkoxy group having up to 12 carbon atoms, a halogen atom or a hydroxyl group.

The structural unit represented by the general formula (IV) has preferably the following groups:

$X^1$ represents an alkylene, cyclohexylene, phenylene or tolylene group, —O—, —S—, —CO—, —CO—O—, —O—CO—, —CS—, —$NR^hR^i$—, —CO—$NR^h$—, —$NR^h$—CO—, —$NR^h$—CO—O—, —O—CO—$NR^h$, —$NR^h$—CO—$NR^i$—, —$NR^h$—CS—$NR^i$—, or combinations thereof, and wherein $R^h$ and $R^i$ each independently represent hydrogen or an optionally substituted alkyl, alkenyl, alkynyl, cycloalkyl, heterocyclic, aryl, heteroaryl, aralkyl or heteroaralkyl group. Preferred substituents on the latter groups are an alkoxy group having up to 12 carbon atoms, a halogen or a hydroxyl group;

$Y^1$ is a bivalent sulphonamide group represented by —$NR^j$—$SO_2$—, —$SO_2$—$NR^k$— wherein $R^j$ and $R^k$ each independently represent hydrogen, an optionally substituted alkyl, alkanoyl, alkenyl, alkynyl, cycloalkyl, heterocyclic, aryl, heteroaryl, aralkyl or heteroaralkyl group;

$Z^1$ is a terminal group represented by hydrogen, an alkyl group such as a methyl group, an ethyl group, a propyl group, an isopropyl group, a butyl group, an isobutyl group, a t-butyl group, a s-butyl group, a pentyl group, a hexyl group, a cyclopentyl group, a cyclohexyl group or an octyl group, a benzyl group, an optionally substituted aryl or heteroaryl group, a naphtyl group, an anthracenyl group, a pyridyl group, an allyl group or a vinyl group.

Specific preferred examples of sulphonamide (co)polymers are polymers comprising N-(p-aminosulfonylphenyl) (meth)acrylamide, N-(m-aminosulfonylphenyl) (meth)acrylamide and/or N-(o-aminosulfonylphenyl) (meth) acrylamide. A particularly preferred sulphonamide (co)polymer is a polymer comprising N-(p-aminosulphonylphenyl)methacrylamide wherein the sulphonamide group comprises an optionally substituted straight, branched, cyclic or heterocyclic alkyl group, an optionally substituted aryl group or an optionally substituted heteroaryl group.

The layer comprising the sulphonamide (co)polymer may further comprise additional hydrophobic binders such as a phenolic resin (e.g. novolac, resoles or polyvinyl phenols), a chemically modified phenolic resin or a polymer containing a carboxyl group, a nitrile group or a maleimide group.

The dissolution behavior of the coating of the latter embodiment in the developer can be fine-tuned by optional solubility regulating components. More particularly, development accelerators and development inhibitors can be used. In the embodiment where the coating comprises more than one layer, these ingredients can be added to the first layer, to the second layer and/or to an optional other layer of the coating.

Development accelerators are compounds which act as dissolution promoters because they are capable of increasing the dissolution rate of the coating. For example, cyclic acid anhydrides, phenols or organic acids can be used in order to improve the aqueous developability. Examples of the cyclic acid anhydride include phthalic anhydride, tetrahydrophthalic anhydride, hexahydrophthalic anhydride, 3,6-endoxy-4-tetrahydro-phthalic anhydride, tetrachlorophthalic anhydride, maleic anhydride, chloromaleic anhydride, alpha-phenylmaleic anhydride, succinic anhydride, and pyromellitic anhydride, as described in U.S. Pat. No. 4,115,128. Examples of the phenols include bisphenol A, p-nitrophenol, p-ethoxyphenol, 2,4,4'-trihydroxybenzophenone, 2,3,4-trihydroxy-benzophenone, 4-hydroxybenzophenone, 4,4',4"-trihydroxy-triphenylmethane, and 4,4',3",4"-tetrahydroxy-3,5,3',5'-tetramethyltriphenyl-methane, and the like. Examples of the organic acids include sulphonic acids, sulfinic acids, alkylsulfuric acids, phosphonic acids, phosphates, and carboxylic acids, as described in, for example, JP-A Nos. 60-88,942 and 2-96,755. Specific examples of these organic acids include p-toluenesulphonic acid, dodecylbenzenesulphonic acid, p-toluenesulfinic acid, ethylsulfuric acid, phenylphosphonic acid, phenylphosphinic acid, phenyl phosphate, diphenyl phosphate, benzoic acid, isophthalic acid, adipic acid, p-toluic acid, 3,4-dimethoxybenzoic acid, 3,4,5-trimethoxybenzoic acid, 3,4,5-trimethoxycinnamic acid, phthalic acid, terephthalic acid, 4-cyclohexene-1,2-dicarboxylic acid, erucic acid, lauric acid, n-undecanoic acid, and ascorbic acid. The amount of the cyclic acid anhydride, phenol, or organic acid contained in the coating is preferably in the range of 0.05 to 20% by weight, relative to the coating as a whole. Polymeric development accelerators such as phenolic-formaldehyde resins comprising at least 70 mol % meta-cresol as recurring monomeric units are also suitable development accelerators.

In a preferred embodiment, the coating also contains developer resistance means, also called development inhibitors, i.e. one or more ingredients which are capable of delaying the dissolution of the unexposed areas during processing. The dissolution inhibiting effect is preferably reversed by heating, so that the dissolution of the exposed areas is not substantially delayed and a large dissolution differential between exposed and unexposed areas can thereby be obtained. The compounds described in e.g. EP-A 823 327 and WO97/39894 are believed to act as dissolution inhibitors due to interaction, e.g. by hydrogen bridge formation, with the alkali-soluble resin(s) in the coating. Inhibitors of this type typically comprise at least one hydrogen bridge forming group such as nitrogen atoms, onium groups, carbonyl (—CO—), sulfinyl (—SO—) or sulfonyl (—$SO_2$—) groups and a large hydrophobic moiety such as one or more aromatic rings. Some of the compounds mentioned below, e.g. infrared dyes such as cyanines and contrast dyes such as quaternized triarylmethane dyes can also act as a dissolution inhibitor.

Other suitable inhibitors improve the developer resistance because they delay the penetration of the aqueous alkaline developer into the coating. Such compounds can be present in the first layer and/or, if present, in the second layer as described in e.g. EP-A 950 518, and/or in a development barrier layer on top of said layer, as described in e.g. EP-A 864 420, EP-A 950 517, WO 99/21725 and WO 01/45958. In the latter embodiment, the solubility of the barrier layer in the developer or the penetrability of the barrier layer by the developer can be increased by exposure to heat or infrared light.

Preferred examples of inhibitors which delay the penetration of the aqueous alkaline developer into the coating include the following:

(a) A polymeric material which is insoluble in or impenetrable by the developer, e.g. a hydrophobic or water-repellent polymer or copolymer such as acrylic polymers, polystyrene, styrene-acrylic copolymers, polyesters, polyamides, polyureas, polyurethanes, nitrocellulosics and epoxy resins; or polymers comprising siloxane (silicones) and/or perfluoroalkyl units.

(b) Bifunctional compounds such as surfactants comprising a polar group and a hydrophobic group such as a long chain hydrocarbon group, a poly- or oligosiloxane and/or a perfluorinated hydrocarbon group. A typical example is Megafac F-177, a perfluorinated surfactant available from Dainippon Ink & Chemicals, Inc. A suitable amount of such compounds is between 10 and 100 mg/$m^2$, more preferably between 50 and 90 mg/$m^2$.

(c) Bifunctional block-copolymers comprising a polar block such as a poly- or oligo(alkylene oxide) and a hydrophobic block such as a long chain hydrocarbon group, a poly- or oligosiloxane and/or a perfluorinated hydrocarbon group. A suitable amount of such compounds is between 0.5 and 25 mg/$m^2$, preferably between 0.5 and 15 mg/$m^2$ and most preferably between 0.5 and 10 mg/$m^2$. A suitable copolymer comprises about 15 to 25 siloxane units and 50 to 70 alkyleneoxide groups. Preferred examples include copolymers comprising phenylmethylsiloxane and/or dimethylsiloxane as well as ethylene oxide and/or propylene oxide, such as Tego Glide 410, Tego Wet 265, Tego Protect 5001 or Silikophen P50/X, all commercially available from Tego Chemie, Essen, Germany. Said poly- or oligosiloxane may be a linear, cyclic or complex cross-linked polymer or copolymer. The term polysiloxane compound shall include any compound which contains more than one siloxane group —Si(R,R')—O—, wherein R and R' are optionally substituted alkyl or aryl groups. Preferred siloxanes are phenylalkylsiloxanes and dialkylsiloxanes. The number of siloxane groups in the polymer or oligomer is at least 2, preferably at least 10, more preferably at least 20. It may be less than 100, preferably less than 60.

It is believed that during coating and drying, the above mentioned inhibitor of type (b) and (c) tends to position itself, due to its bifunctional structure, at the interface between the coating and air and thereby forms a separate top layer even when applied as an ingredient of the coating solution of the first and/or of the optional second layer. Simultaneously, the surfactants also act as a spreading agent which improves the coating quality. The separate top layer thus formed seems to be capable of acting as the above mentioned barrier layer which delays the penetration of the developer into the coating.

Alternatively, the inhibitor of type (a) to (c) can be applied in a separate solution, coated on top of the first, optional second and/or other layers of the coating. In that embodiment, it may be advantageous to use a solvent in the separate solution that is not capable of dissolving the ingredients present in the other layers so that a highly concentrated water-repellent or hydrophobic phase is obtained at the top of the coating which is capable of acting as the above mentioned development barrier layer.

In addition, the first or optional second layer and/or other layer may comprise polymers that further improve is the run length and/or the chemical resistance of the plate. Examples thereof are polymers comprising imido (—CO—NR—CO—) pendant groups, wherein R is hydrogen, optionally substituted alkyl or optionally substituted aryl, such as the polymers described in EP-A 894 622, EP-A 901 902, EP-A 933 682 and WO 99/63407.

The coating of the heat-sensitive printing plate precursors described above preferably also contains an infrared light absorbing dye or pigment which, in the embodiment where the coating comprises more than one layer, may be present in the first layer, and/or in the second layer, and/or in an optional other layer. Preferred IR absorbing dyes are cyanine dyes, merocyanine dyes, indoaniline dyes, oxonol dyes, pyrilium dyes and squarilium dyes. Examples of suitable IR dyes are described in e.g. EP-As 823327, 978376, 1029667, 1053868, 1093934; WO 97/39894 and 00/29214. Preferred compounds are the following cyanine dyes:

IR-1

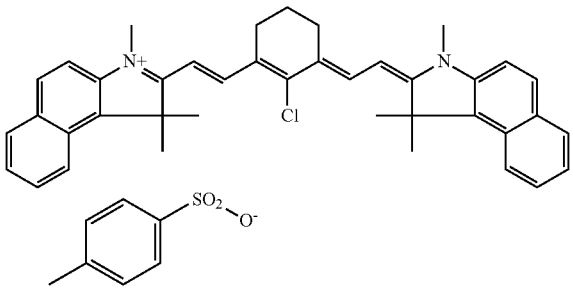

-continued

IR-2

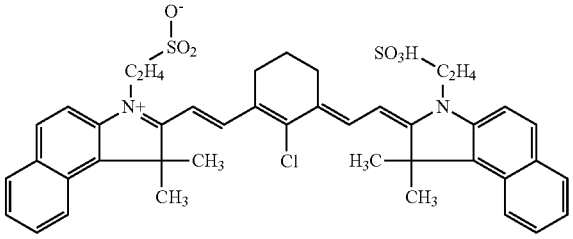

The concentration of the IR-dye in the coating is preferably between 0.25 and 15.0% wt, more preferably between 0.5 and 10.0% wt, most preferably between 1.0 and 7.5% wt relative to the coating as a whole.

The coating may further comprise one or more colorant(s) such as dyes or pigments which provide a visible color to the coating and which remain in the coating at the image areas which are not removed during the processing step. Thereby a visible image is formed and examination of the is lithographic image on the developed printing plate becomes feasible. Such dyes are often called contrast dyes or indicator dyes. Preferably, the dye has a blue color and an absorption maximum in the wavelength range between 600 nm and 750 nm. Typical examples of such contrast dyes are the amino-substituted tri- or diarylmethane dyes, e.g. crystal violet, methyl violet, victoria pure blue, flexoblau 630, basonylblau 640, auramine and malachite green. Also the dyes which are discussed in depth in EP-A 400,706 are suitable contrast dyes. Dyes which, combined with specific additives, only slightly color the coating but which become intensively colored after exposure, as described in for example WO2006/005688 may also be used as colorants.

The heat-sensitive plate precursor can be image-wise exposed directly with heat, e.g. by means of a thermal head, or indirectly by infrared light, preferably near infrared light. The infrared light is preferably converted into heat by an IR light absorbing compound as discussed above. The heat-sensitive lithographic printing plate precursor is preferably not sensitive to visible light, i.e. no substantial effect on is the dissolution rate of the coating in the developer is induced by exposure to visible light. Most preferably, the coating is not sensitive to ambient daylight.

The printing plate precursor can be exposed to infrared light by means of e.g. LEDs or a laser. Most preferably, the light used for the exposure is a laser emitting near infrared light having a wavelength in the range from about 750 to about 1500 nm, more preferably 750 to 1100 nm, such as a semiconductor laser diode, a Nd:YAG or a Nd:YLF laser. The required laser power depends on the sensitivity of the plate precursor, the pixel dwell time of the laser beam, which is determined by the spot diameter (typical value of modern plate-setters at $1/e^2$ of maximum intensity: 5-25 μm), the scan speed and the resolution of the exposure apparatus (i.e. the number of addressable pixels per unit of linear distance, often expressed in dots per inch or dpi; typical value: 1000-4000 dpi).

Two types of laser-exposure apparatuses are commonly used: internal (ITD) and external drum (XTD) platesetters. ITD plate-setters for thermal plates are typically characterized by a very high scan speed up to 500 m/sec and may require a laser power of several Watts. XTD plate-setters for thermal plates having a typical laser power from about 200 mW to about 1 W operate at a lower scan speed, e.g. from 0.1 to 10 m/sec. An XTD platesetter equipped with one or more laserdiodes emitting in the wavelength range between 750 and 850 nm is an especially preferred embodiment for the method of the present invention.

The known plate-setters can be used as an off-press exposure apparatus, which offers the benefit of reduced press down-time. XTD plate-setter configurations can also be used for on-press exposure, offering the benefit of immediate registration in a multi-color press. More technical details of on-press exposure apparatuses are described in e.g. U.S. Pat. No. 5,174,205 and U.S. Pat. No. 5,163,368.

After exposure, the precursor can be developed by means of a suitable processing liquid, such as an aqueous alkaline solution, whereby the non-image areas of the coating are removed; the development step may be combined with mechanical rubbing, e.g. by using a rotating brush. During development, any water-soluble protective layer present is also removed. The heat-sensitive printing plate precursors based on latex coalescence, can also be developed using plain water or aqueous solutions, e.g. a gumming solution as described in EP 1,342,568. Alternatively, such printing plate precursors can after exposure directly be mounted on a printing press and be developed on-press by supplying ink and/or fountain to the precursor.

More details concerning the development step can be found in for example EP 1614538, EP 1614539, EP 1614540 and WO/2004071767.

Light-Sensitive Printing Plate Precursors.

In addition to the above thermal materials, also light-sensitive coatings can be used. Typical examples of such plates are the UV-sensitive "PS" plates and the so-called photopolymer plates which contain a photopolymerizable composition that hardens upon exposure to light.

In a particular embodiment of the present invention, a conventional, UV-sensitive "PS" plate precursor is used. Suitable examples of such plates precursors, that are sensitive in the range of 300-450 nm (near UV and blue light), have been discussed in EP 1,029,668 A2. Positive and negative working compositions are typically used in "PS" plate precursors.

The positive working imaging layer preferably comprises an o-naphtoquinonediazide compound (NQD) and an alkali soluble resin. Particularly preferred are o-naphthoquinone-diazidosulphonic acid esters or o-naphthoquinone diazidocarboxylic acid esters of various hydroxyl compounds and o-naphthoquinone-diazidosulphonic acid amides or o-naphthoquinone-diazidocarboxylic acid amides of various aromatic amine compounds. Two variants of NQD systems can be used: one-component systems and two-component systems. Such light-sensitive printing plates have been widely disclosed in the prior art, for example in U.S. Pat. No. 3,635,709, J.P. KOKAI No. 55-76346, J.P. KOKAI No. Sho 50-117503, J.P. KOKAI No. Sho 50-113305, U.S. Pat. No. 3,859,099; U.S. Pat. No. 3,759,711; GB-A 739654, U.S. Pat. No. 4,266,001 and J.P. KOKAI No. 55-57841.

The negative working layer of a "PS" plate preferably comprises a diazonium salt, a diazonium resin or an aryldiazosulfonate homo- or copolymer. Suitable examples of low-molecular weight diazonium salts include: benzidine tetrazoniumchloride, 3,3'-dimethylbenzidine tetrazoniumchloride, 3,3'-dimethoxybenzidine tetrazoniumchloride, 4,4'-diaminodiphenylamine tetrazoniumchloride, 3,3'-diethylbenzidine tetrazoniumsulfate, 4-aminodiphenylamine diazoniumsulfate, 4-aminodiphenylamine diazoniumchloride, 4-piperidino aniline diazoniumsulfate, 4-diethylamino aniline diazoniumsulfate and oligomeric condensation products of diazodiphenylamine and formaldehyde. Examples of diazo resins include condensation products of an aromatic diazonium salt as the light-sensitive substance. Such condensation products are described, for example, in DE-P-1 214 086. The light- or heat-sensitive layer preferably also contains a binder e.g. polyvinyl alcohol.

Upon exposure the diazo resins or diazonium salts are converted from water soluble to water insoluble (due to the destruction of the diazonium groups) and additionally the photolysis products of the diazo may increase the level of crosslinking of the polymeric binder or diazo resin, thereby selectively converting the coating, in an image pattern, from water soluble to water insoluble. The unexposed areas remain unchanged, i.e. water-soluble.

Such printing plate precursors can be developed using an aqueous alkaline solution as described above.

In a second suitable embodiment, the light sensitive printing plate precursor is based on a photo-polymerisation reaction and contains a coating comprising a photocurable composition comprising a free radical initiator (as disclosed in for example U.S. Pat. No. 5,955,238; U.S. Pat. No. 6,037,098; U.S. Pat. No. 5,629,354; U.S. Pat. No. 6,232,038; U.S. Pat. No. 6,218,076; U.S. Pat. No. 5,955,238; U.S. Pat. No. 6,037,098; U.S. Pat. No. 6,010,824; U.S. Pat. No. 5,629,354; DE 1,470,154; EP 024,629; EP 107,792; U.S. Pat. No. 4,410,621; EP 215,453; DE 3,211,312 and EP A 1,091,247) a polymerizable compound (as disclosed in EP1,161,4541, EP 1349006, WO2005/109103 and unpublished European patent applications EP 5,111,012.0, EP 5,111,025.2, EP 5110918.9 and EP 5, 110,961.9) and a polymeric binder (as disclosed in for example US2004/0260050, US2005/0003285; US2005/0123853; EP 1,369,232; EP 1,369,231; EP 1,341,040; US 2003/0124460, EP 1 241 002, EP 1 288 720, U.S. Pat. No. 6,027,857, U.S. Pat. No. 6,171,735; U.S. Pat. No. 6,420,089; EP 152,819; EP 1,043, 627; U.S. Pat. No. 6,899,994; US2004/0260050; US 2005/0003285; US2005/0170286; US2005/0123853; US2004/0260050; US2005/0003285; US 2004/0260050; US 2005/0003285; US 2005/0123853 and US2005/0123853). Other ingredients such as sensitizers, co-initiators, adhesion promoting compounds, colorants, surfactants and/or printing out agents may optionally be added. These printing plate precursors can be sensitized with blue, green or red light (i.e. wavelength range between 450 and 750 nm), with violet light (i.e. wavelength range between 350 and 450 nm) or with infrared light (i.e. wavelength range between 750 and 1500 nm) using for example an Ar laser (488 nm) or a FD-YAG laser (532 nm), a semiconductor laser InGaN (350 to 450 nm), an infrared laser diode (830 nm) or a Nd-YAG laser (1064 nm).

Typically, a photopolymer plate precursor is processed in alkaline developer having a pH>10 (see above) and subsequently gummed. Alternatively, the exposed photopolymer plate precursor can also be developed by applying a gum solution to the coating whereby the non-exposed areas are removed. Suitable gumming solutions are described in WO/2005/111727. After the exposure step, the imaged precursor can also be directly mounted on a press and processed on-press by applying ink and/or fountain solution. Methods for preparing such plates are disclosed in WO 93/05446, U.S. Pat. No. 6,027,857, U.S. Pat. No. 6,171,735, U.S. Pat. No. 6,420,089, U.S. Pat. No. 6,071,675, U.S. Pat. No. 6,245,481, U.S. Pat. No. 6,387,595, U.S. Pat. No. 6,482,571, U.S. Pat. No. 6,576,401, U.S. Pat. No. 6,548,222, WO 03/087939, US 2003/16577 and US 2004/13968.

To protect the surface of the coating of the heat and/or light sensitive printing plate precursors, in particular from mechanical damage, a protective layer may also optionally be applied. The protective layer generally comprises at least one water-soluble binder, such as polyvinyl alcohol, polyvinylpyrrolidone, partially hydrolyzed polyvinyl acetates, gelatin, carbohydrates or hydroxyethylcellulose, and can be produced in any known manner such as from an aqueous solution or dispersion which may, if required, contain small amounts—i.e. less than 5% by weight based on the total weight of the coating solvents for the protective layer—of organic solvents. The thickness of the protective layer can suitably be any amount, advantageously up to 5.0 μm, preferably from 0.1 to 3.0 μm, particularly preferably from 0.15 to 1.0 μm.

Optionally, the coating may further contain additional ingredients such as surfactants, especially perfluoro surfactants, silicon or titanium dioxide particles or polymers particles such as matting agents and spacers.

Any coating method can be used for applying two or more coating solutions to the hydrophilic surface of the support. The multi-layer coating can be applied by coating/drying each layer consecutively or by the simultaneous coating of several coating solutions at once. In the drying step, the volatile solvents are removed from the coating until the coating is self-supporting and dry to the touch. However it is not necessary (and may not even be possible) to remove all the solvent in the drying step. Indeed the residual solvent content may be regarded as an additional composition variable by means of which the composition may be optimized. Drying is typically carried out by blowing hot air onto the coating, typically at a temperature of at least 70° C., suitably 80-150° C. and especially 90-140° C. Also infrared lamps can be used. The drying time may typically be 15-600 seconds.

Between coating and drying, or after the drying step, a heat treatment and subsequent cooling may provide additional benefits, as described in WO99/21715, EP-A 1074386, EP-A 1074889, WO00/29214, and WO/04030923, WO/04030924, WO/04030925.

The heat and/or light sensitive printing plates can be treated with the cleaning liquid used in the present invention. Than, they can be used for conventional, so-called wet offset printing, in which ink and an aqueous dampening liquid are supplied to the plate. Another suitable printing method uses so-called single-fluid ink without a dampening liquid. Suitable single-fluid inks have been described in U.S. Pat. No. 4,045,232; U.S. Pat. No. 4,981,517 and U.S. Pat. No. 6,140,392. In a most preferred embodiment, the single-fluid ink comprises an ink phase, also called the hydrophobic or oleophilic phase, and a polyol phase as described in WO 00/32705. Also during the printing step the cleaning liquid of the present invention can be applied to the printing plates.

The treating liquid used in the present invention can also be used for treating thermo-resists, for example on a PCB (printed circuit board) application as described in US 2003/0003406 A1.

EXAMPLES

Example 1

1. Preparation of the Reference Plate Cleaner PC-01

A good performing reference plate cleaner PC-01 with the composition given in Table 1 was prepared as follows.

Preparation of the Aqueous Phase:

Citric acid monohydrate is added to demineralized water and mixed until fully dissolved. Then Parmetol A26 is added while mixing; and subsequently phosphoric acid 85% w/w and Rewopol D510 are added and mixed until they are dissolved.

Preparation of the Solvent Phase:

Atlas G3300 B, NANSA YS94 and Caflon PHC040 are added to Exxsol D-40 and Solvesso 100 and mixed until they are fully dissolved.

Preparation of the Emulsion.

The solvent phase is added to the aqueous phase while mixing keeping the mixing blades just below the emulsion surface (high-shear Silversone mixer). Once the emulsion is formed and all the solvent has been added, the emulsion is further slowly mixed for 10 minutes.

TABLE 1 composition of reference plate cleaner PC-01.

| Ingredients | g |
|---|---|
| Aqueous Phase | |
| Demineralized water | 431.05 |
| Parmetol A26 (1) | 0.80 |
| Citric acid monohydrate | 52.50 |
| Phosphoric acid 85% w/w | 47.65 |
| Rewopol D510 (2) | 4.20 |
| Solvent Phase | |
| Exxsol D-40 (3) | 251 |
| Solvesso 100 (4) | 189.60 |
| Atlas G3300 B (5) | 2.0 |
| NANSA YS94 (6) | 2.0 |
| Caflon PHC040 (7) | 2.0 |

(1) Biocide, trade name of Schülke & Maier GmbH (Germany);
(2) 2-ethylhexylsulfate commercially available from Goldschmidt;
(3) Exxsol D-40 is an aliphatic hydrocarbon solvent mixture with a flash point of 40° C., trade name of Exxon;
(4) $C_9$-$C_{10}$ aromatic hydrocarbon solvent mixture, trade name of Exxon;
(5) alkylarylsulphonate surfactant, trade name of Uniquema;
(6) iso-propylamidedodecylbenzenesulphonate surfactant, trade name of Huntsman;
(7) alkyletholyate ($C_4$-4EO) surfactant, tradename of Unilever.

The solvent level of the reference plate cleaner is 44.7% wt.

2. Preparation of Inventive Plate Cleaner PC-02

The inventive plate cleaner PC-02 with the composition given in Table 2 was prepared as follows.

Preparation of the Aqueous Phase:

The components of the aqueous part, except for Rheogel IRX55395, were added to demineralized water at room temperature and stirred until all components were completely dissolved.

Preparation of the Solvent Phase:

The components of the organic part were mixed at room temperature.

Preparation of the Emulsion.

While stirring @ 15K revolutions/minute in an Ultra Turrax T25 digital mixer equipped with a S25N mixing head (both trademarks of IKA Werke GmbH & Co) the organic part was very slowly added into the vortex of the aqueous part. After complete addition of the organic part, the resulting emulsion was stirred for an additional 2 minutes at the same speed. Then the foam is allowed to dissipate in the emulsion.

Finally, Rheogel IRX55395 was added slowly to this emulsion avoiding lump formation and the resulting plate cleaner was stirred for an additional 30 minutes using a stirrer RW20 (trademark of IKA Werke GmbH & Co) equipped with a dispersion disk R1303 (trademark of IKA Werke GmbH & Co). The rotational speed was gradually increased in order to account for the increasing viscosity.

TABLE 2 composition of the inventive plate cleaner PC-02.

| Ingredients | g |
|---|---|
| Aqueous Phase | |
| Demineralized water | 58.42 |
| Parmetol A26 (1) | 0.15 |
| Glucopon 600 CSUP (2) | 1.28 |
| Phosphoric acid 85% wt | 2.92 |
| Sorbitol (3) | 7.30 |
| Solvent Phase | |
| Exxsol D-60 (4) | 19.46 |
| Solvesso 150 ND (5) | 9.75 |
| Thickener | |
| Rheogel IRX 55395 (6) | 0.73 |

(1) see Table 1;

(2) Glucopon 600 CSUP: alkyl (poly)glucoside from Cognis with $C_{12}$-$C_{14}$ and an average number of glucoside units of 1.4;

(3) 70% solution of sorbitol from Roquette Freres SA, France;

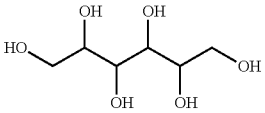

(4) aliphatic hydrocarbon solvent with a flash point of 62° C., tradename of Exxon;

(5) $C_{10}$-$C_{11}$ aromatic hydrocarbon solvent mixture, tradename of Exxon; naphthalene depleted (ND) indicates a naphthalene content of less than 1.0 weight percent;

(6) Xhantan gum thickener, tradename of CNI SA, France.

The solvent level of this plate cleaner is 29.21 wt %.

3. Evaluation of the Plate Cleaners PC-01 and PC-02

The plate cleaners were evaluated using a printing plate Thermostar P970 (trademark of Agfa-Graphics) on a Heidelberg Speedmaster SM74 printing press (available from Heidelberger Druckmaschinen AG) using the following printing conditions:

ink: K+E 700 black ink (trademark of K&E).

fountain solution: 4% Agfa Prima FS303 (trademark of Agfa-Graphics)+10% isopropanol.

paper: machine-coated paper (90 g/m$^2$).

The cleaning efficiency of both plate cleaners was independently evaluated by a panel of 4 press operators using common plate cleaning procedures. A small amount of plate cleaner was applied on a sponge (wetted with fountain solution) and subsequently this sponge was used to clean the plate on the press.

The operators unanimously indicated that both plate cleaners were equally performing in terms of cleaning efficiency and ink solvency, while the odor of the plate cleaner according to the present invention PC-02 was clearly preferred. Both plate cleaners did not damage the image parts of the plate. The plate cleaner PC-02 has a solvent level of is only 29.21% wt, while the reference plate cleaner has a solvent level of 44.7% wt.

Example 2

1. Preparation of Plate Cleaners PC-03 to PC-07

The plate cleaners PC-03 to PC-07 with the composition given in Table 3 were prepared in the same way as PC-02 (see Example 1, no. 2).

TABLE 3 composition of the plate cleaner PC-03 to PC-07.

| Ingredients *g | PC-03 | PC-04 | PC-05 | PC-06 | PC-07 |
|---|---|---|---|---|---|
| Aqueous Phase | | | | | |
| Demineralized water | 50.4 | 50.1 | 49.9 | 50.8 | 50.55 |
| Parmetol A26 | 0.2 | 0.15 | 0.14 | 0.15 | 0.15 |
| Sorbitol | 7.3 | 7.24 | 7.21 | 7.38 | 7.30 |
| Phosphoric acid 85% wt | 2.9 | 2.9 | 2.89 | 2.93 | 2.92 |
| Glucopon 600 SCUP | 1.8 | 2.3 | 2.8 | 1.0 | 1.50 |
| Parmetol A26 | 0.2 | 0.15 | 0.14 | 0.15 | 0.15 |
| Sodium hydroxide solution (% wt) | 7.8 | 8 | 8 | 7.9 | 7.86 |
| Solvent Phase | | | | | |
| Exxsol D-60 | 19.3 | 19.2 | 19.1 | 19.44 | 19.35 |
| Solvesso 150 ND | 9.7 | 9.6 | 9.54 | 9.72 | 9.67 |
| Thickener | | | | | |
| Rheogel IRX 55395 | 0.7 | 0.69 | 0.69 | 0.7 | 0.7 |

*: ingredients as defined in Table 2.

In Table 4 the solvent level and the level of alkyl (poly) glucoside (APG) surfactant of the cleaning liquids PC-03 to PC-07 are summarized.

TABLE 4 composition of the plate cleaner PC-03 to PC-07

| | PC-03 | PC-04 | PC-05 | PC-06 | PC-07 |
|---|---|---|---|---|---|
| Solvent level % wt | 29.0 | 28.8 | 28.64 | 29.16 | 29.02 |
| Concentration of APG surfactant % wt | 1.8 | 2.3 | 2.8 | 1.0 | 1.5 |

2. Evaluation of the Plate Cleaners PC-03 to PC-07

The plate cleaners PC-03 to PC-07 and reference PC-02 were evaluated using a printing plate Thermostar P970 (trademark of Agfa-Graphics) on a Heidelberg Speedmaster SM74 printing press (available from Heidelberger Druckmaschinen AG), using the following printing conditions:

ink: K+E 700 black ink (trademark of K&E).

fountain solution: 4% Agfa Prima FS303 (trademark of Agfa-Graphics)+10% isopropanol.

paper: machine-coated paper (90 g/m$^2$).

The cleaning efficiency of the plate cleaners was evaluated by applying a small amount of plate cleaner on a sponge (wetted with fountain solution) and subsequently using this sponge to clean the plate on the press.

The plate cleaner formulations PC-03 to PC-07 nor the reference plate cleaner formulation PC-02 damaged the image parts of the plate. The results of the ink solvency evaluation using common plate cleaning procedures are given in Table 5.

TABLE 5

Ink solvency results of the plate cleaners.

| Plate Cleaner | PC-02 reference | PC-03 | PC-04 | PC-05 | PC-06 | PC-07 |
|---|---|---|---|---|---|---|
| Ink Solvency* | 5 | 4 | 3 | 3 | 5 | 5 |

*The following qualitative ink solvency scale was used:

1 = very poor

2 = poor

3 = not optimal yet

4 = good

5 = very good

The results in Table 5 show that at a concentration above 2.0% wt of alkyl (poly)glucoside surfactant in the cleaning liquid, the ink solvency is not yet optimal (cleaning liquids PC-04 and PC-05) and that below 2.0% wt of alkyl (poly) glucoside surfactant the ink solvency becomes good to is very good (cleaning liquids PC-03, PC-6 and PC-07) and is similar to the ink solvency of the reference cleaning liquid PC-02.

The invention claimed is:

1. A method for cleaning a lithographic printing plate comprising the step of applying to the plate a liquid including an aqueous phase, a solvent phase and at least one alkyl (poly) glucoside, said solvent phase including a mixture comprising aliphatic and/or aromatic hydrocarbons, wherein the amount of solvent phase in the liquid is ≦40% wt.

2. A method according to claim 1, wherein the amount of solvent phase in the liquid is ≦30% wt.

3. The method according to claim 1, wherein the level of alkyl (poly)glucoside is ≦2% wt.

4. The method according to claim 2, wherein the level of alkyl (poly)glucoside is ≦2% wt.

5. The method according to claim 2, wherein the aromatic hydrocarbons are selected from $C_{10}$-$C_{11}$ hydrocarbons.

6. The method according to claim 4, wherein the aromatic hydrocarbons are selected from $C_{10}$-$C_{11}$ hydrocarbons.

7. The method according to claim 5, wherein the aromatic $C_{10}$-$C_{11}$ hydrocarbons are alkyl substituted benzenes.

8. The method according to claim 6, wherein the aromatic $C_{10}$-$C_{11}$ hydrocarbons are alkyl substituted benzenes.

9. The method according to claim 1, wherein the aliphatic hydrocarbons are linear or branched $C_7$-$C_{14}$ hydrocarbons.

10. The method according to claim 4, wherein the aliphatic hydrocarbons are linear or branched $C_7$-$C_{14}$ hydrocarbons.

11. The method according to claim 1, wherein the weight ratio of aromatic hydrocarbons to aliphatic hydrocarbons ranges from 1:3 to 3:1.

12. The method according to claim 4, wherein the weight ratio of aromatic hydrocarbons to aliphatic hydrocarbons ranges from 1:3 to 3:1.

13. The method according to claim 1, wherein the liquid has a flash point of ≧60° C.

14. The method according to claim 4, wherein the liquid has a flash point of ≧60° C.

15. The method according to claim 8, wherein the liquid has a flash point of ≧60° C.

16. The method according to claim 1, wherein the printing plate is obtained by exposing and developing a printing plate precursor comprising a coating including an oleophilic resin which is soluble in an aqueous alkaline developer.

17. The method according to claim 3, wherein the printing plate is obtained by exposing and developing a printing plate precursor comprising a coating including an oleophilic resin which is soluble in an aqueous alkaline developer.

18. The method according to claim 1, wherein the aromatic hydrocarbons are $C_{10}$-$C_{11}$ hydrocarbons and the aliphatic hydrocarbons are linear or branched $C_7$-$C_{14}$ hydrocarbons.

* * * * *